US012448808B2

(12) United States Patent
Hernandez

(10) Patent No.: US 12,448,808 B2
(45) Date of Patent: Oct. 21, 2025

(54) DEPLOYABLE TENT ASSEMBLY

(71) Applicant: Gabriel Hernandez, Highland, CA (US)

(72) Inventor: Gabriel Hernandez, Highland, CA (US)

( * ) Notice: Subject to any disclaimer, the term of this patent is extended or adjusted under 35 U.S.C. 154(b) by 221 days.

(21) Appl. No.: 18/226,373

(22) Filed: Jul. 26, 2023

(65) Prior Publication Data

US 2025/0034902 A1 Jan. 30, 2025

(51) Int. Cl.
*E04H 15/20* (2006.01)

(52) U.S. Cl.
CPC ..... *E04H 15/20* (2013.01); *E04H 2015/203* (2013.01)

(58) Field of Classification Search
CPC ..... E04H 15/20; E04H 2015/203
See application file for complete search history.

(56) References Cited

U.S. PATENT DOCUMENTS 3,338,001 A * 8/1967 Fraser ..... E04H 15/20 52/2.21
D246,469 S * 11/1977 Morton ..... D25/7
4,103,369 A 8/1978 Riordan
4,384,435 A * 5/1983 Polise ..... E04H 15/20 D25/19
5,603,185 A * 2/1997 Murphy ..... A63B 9/00 52/2.17
5,662,509 A * 9/1997 Lieberman ..... A63H 3/06 446/27
D391,374 S * 2/1998 Stafford ..... D25/7
D502,523 S * 3/2005 Orphan ..... D21/831
D627,848 S * 11/2010 Cline ..... D21/814
D628,121 S * 11/2010 Reilly ..... D11/184
D654,549 S 2/2012 Paslawski
10,036,178 B2 7/2018 Ore
11,401,729 B2 8/2022 Cangemi
2012/0042578 A1 2/2012 Chen
2017/0118950 A1 * 5/2017 Xu ..... E04H 15/18
2022/0333400 A1 10/2022 Beaudry

FOREIGN PATENT DOCUMENTS

WO WO2022225963 10/2022

* cited by examiner

*Primary Examiner* — Noah Chandler Hawk

(57) ABSTRACT

A deployable tent assembly for sheltering occupants of an outdoor event includes a tent formed to define a dome such that the tent has the ornamental appearance of an American football helmet. A plurality of tent poles is each integrated into the tent for biasing the tent to define the dome. A balloon is attachable to the tent which comprises a plurality of intersecting members to have the ornamental appearance of a face mask of an American football helmet. A fill port is fluidly integrated into the balloon and the fill port can be fluidly coupled to a source of compressed air for inflating the balloon.

9 Claims, 7 Drawing Sheets

DEPLOYABLE TENT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to tent devices and more particularly pertains to a new tent device for sheltering occupants during an outdoor event. The device includes a tent structured to resemble an American football helmet and a balloon which is structured to resemble a facemask of an American football helmet. The device includes a plurality of tent poles integrated into the tent which bias the tent into a deployed position.

(2) Description of Related Art Including Information Disclosed Under 37 CFR 1.97 and 1.98

The prior art relates to tent devices including a variety of inflatable structures for covering spaces and sheltering occupants. In no instance does the prior art disclose a tent structured to resemble an American football helmet and a balloon which is attachable to the tent and which is structured to resemble the facemask of an American football helmet.

BRIEF SUMMARY OF THE INVENTION

An embodiment of the disclosure meets the needs presented above by generally comprising a tent formed to define a dome such that the tent has the ornamental appearance of an American football helmet. A plurality of tent poles is each integrated into the tent for biasing the tent to define the dome. A balloon is attachable to the tent which comprises a plurality of intersecting members to have the ornamental appearance of a face mask of an American football helmet. A fill port is fluidly integrated into the balloon and the fill port can be fluidly coupled to a source of compressed air for inflating the balloon.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
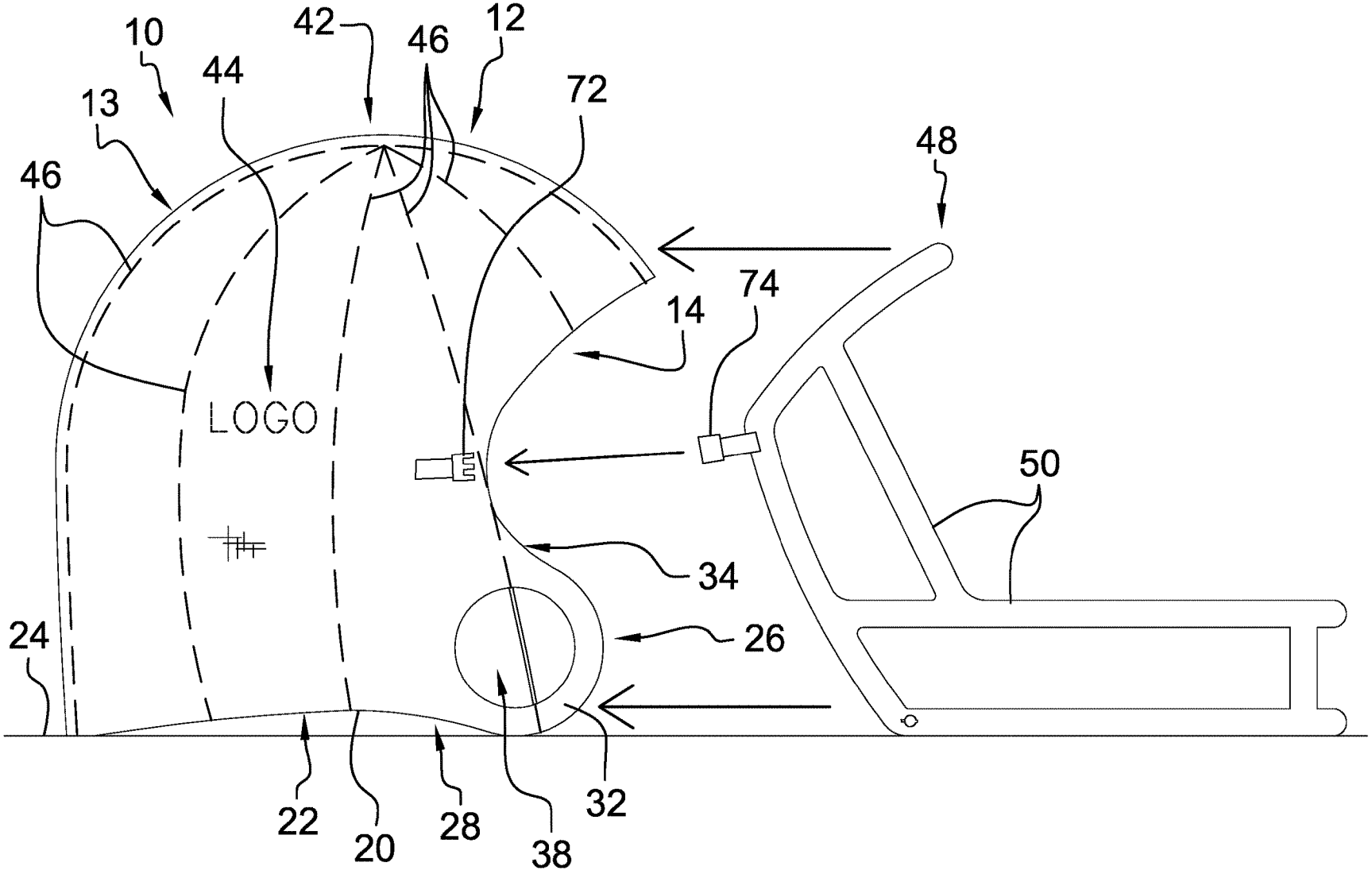
FIG. 1 is a right side exploded view of a deployable tent assembly according to an embodiment of the disclosure.
Figure 2:
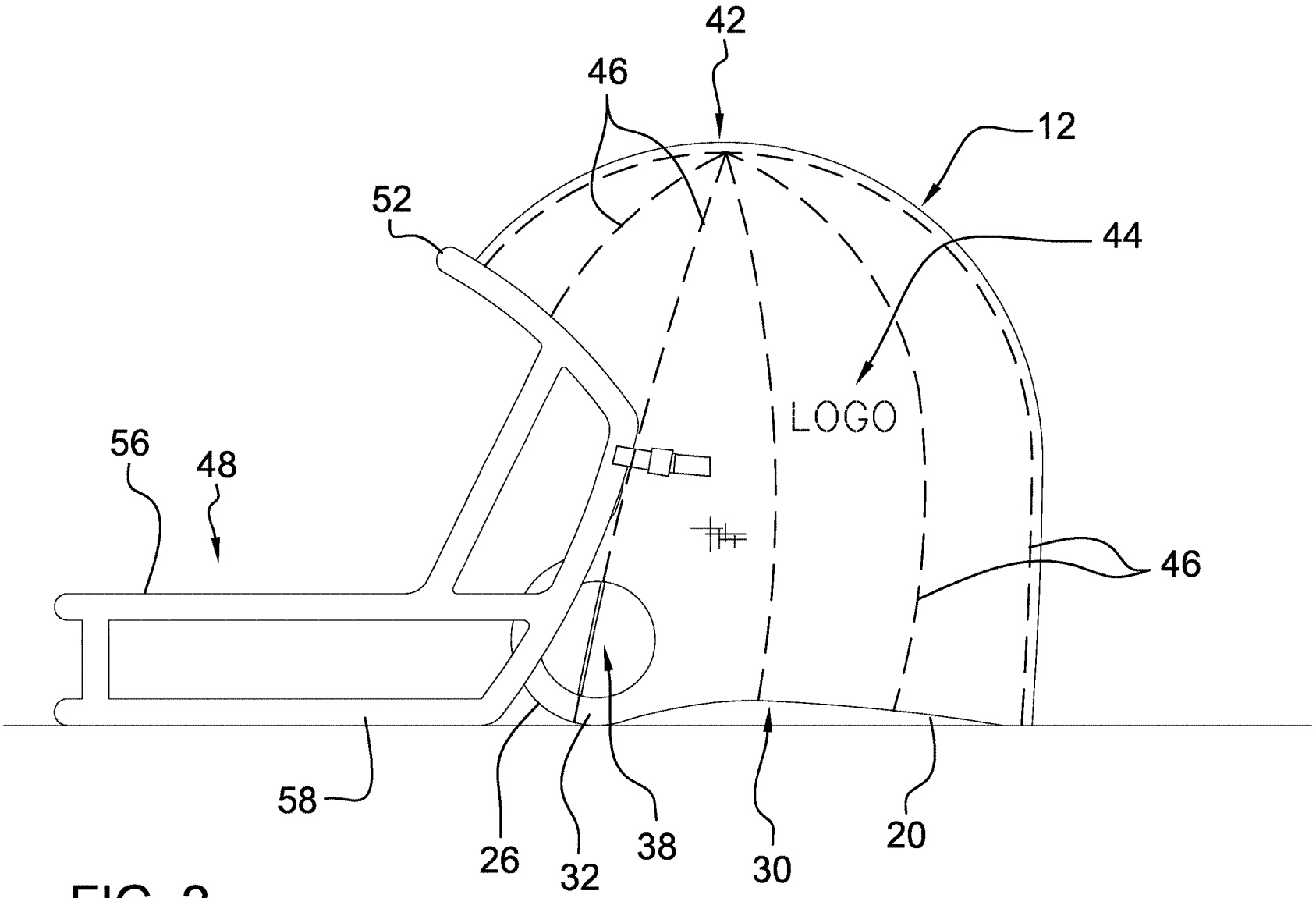
FIG. 2 is a left side view of an embodiment of the disclosure.
Figure 3:
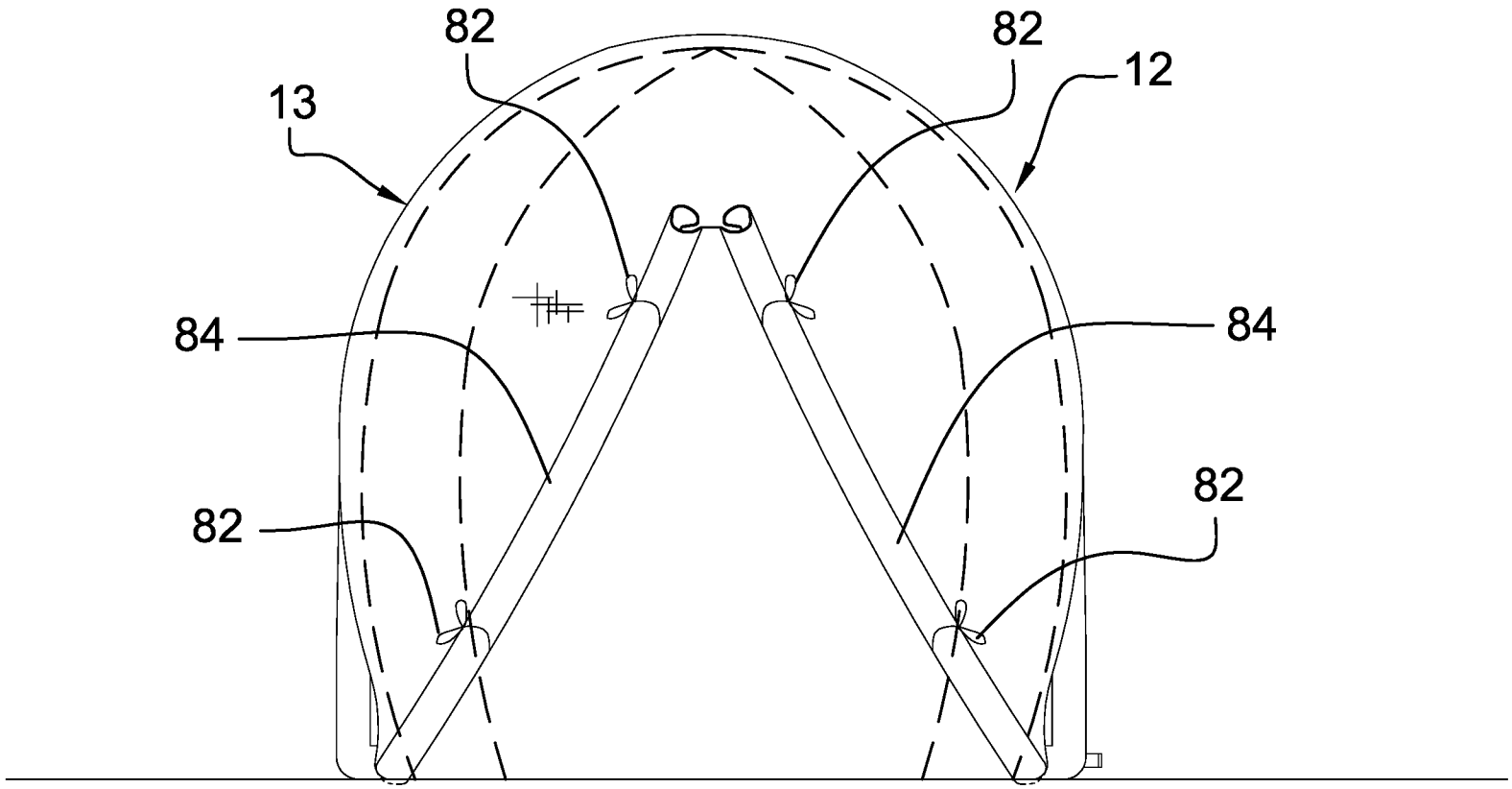
FIG. 3 is a back view of an embodiment of the disclosure.
Figure 4:
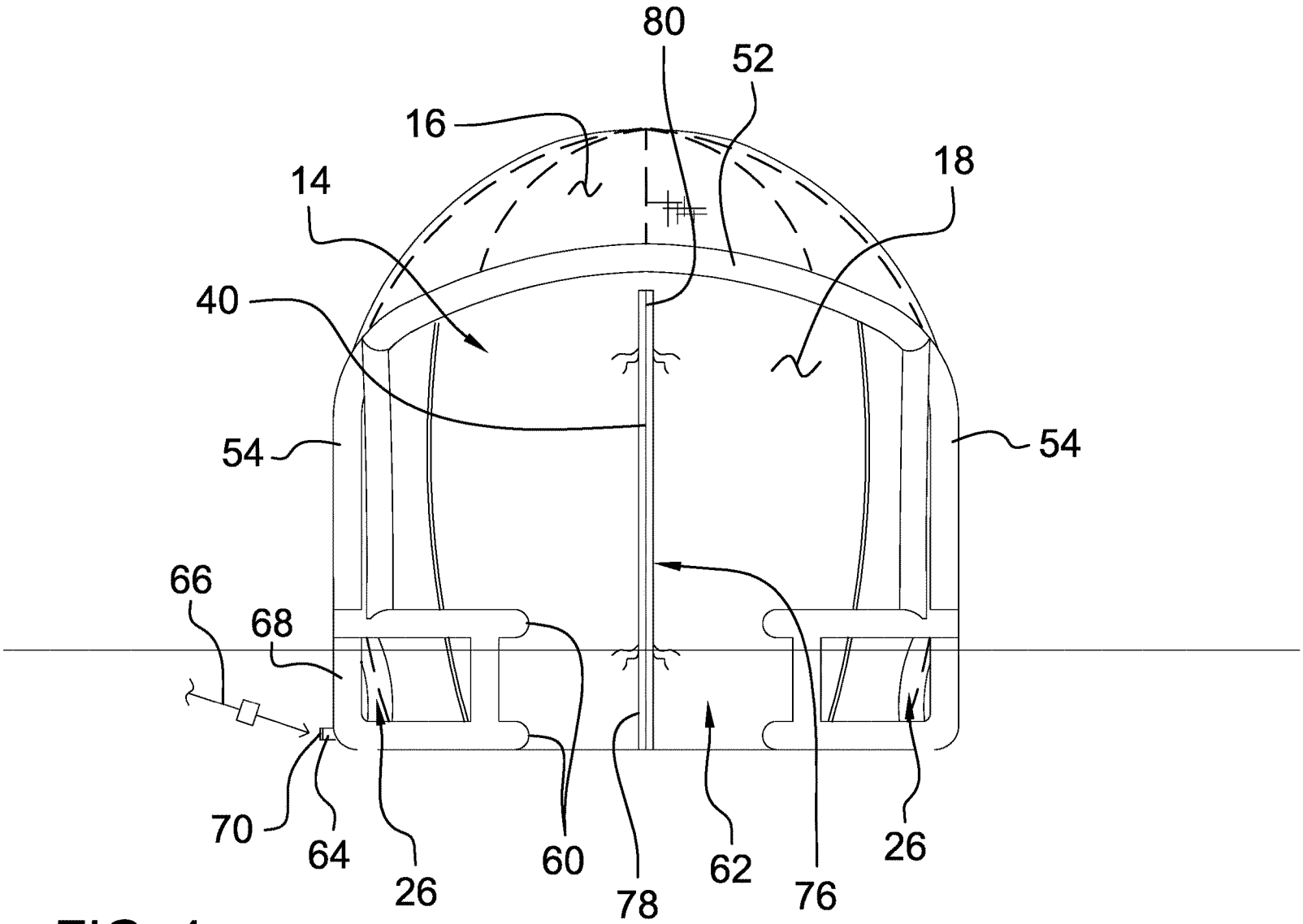
FIG. 4 is a front view of an embodiment of the disclosure.
Figure 5:
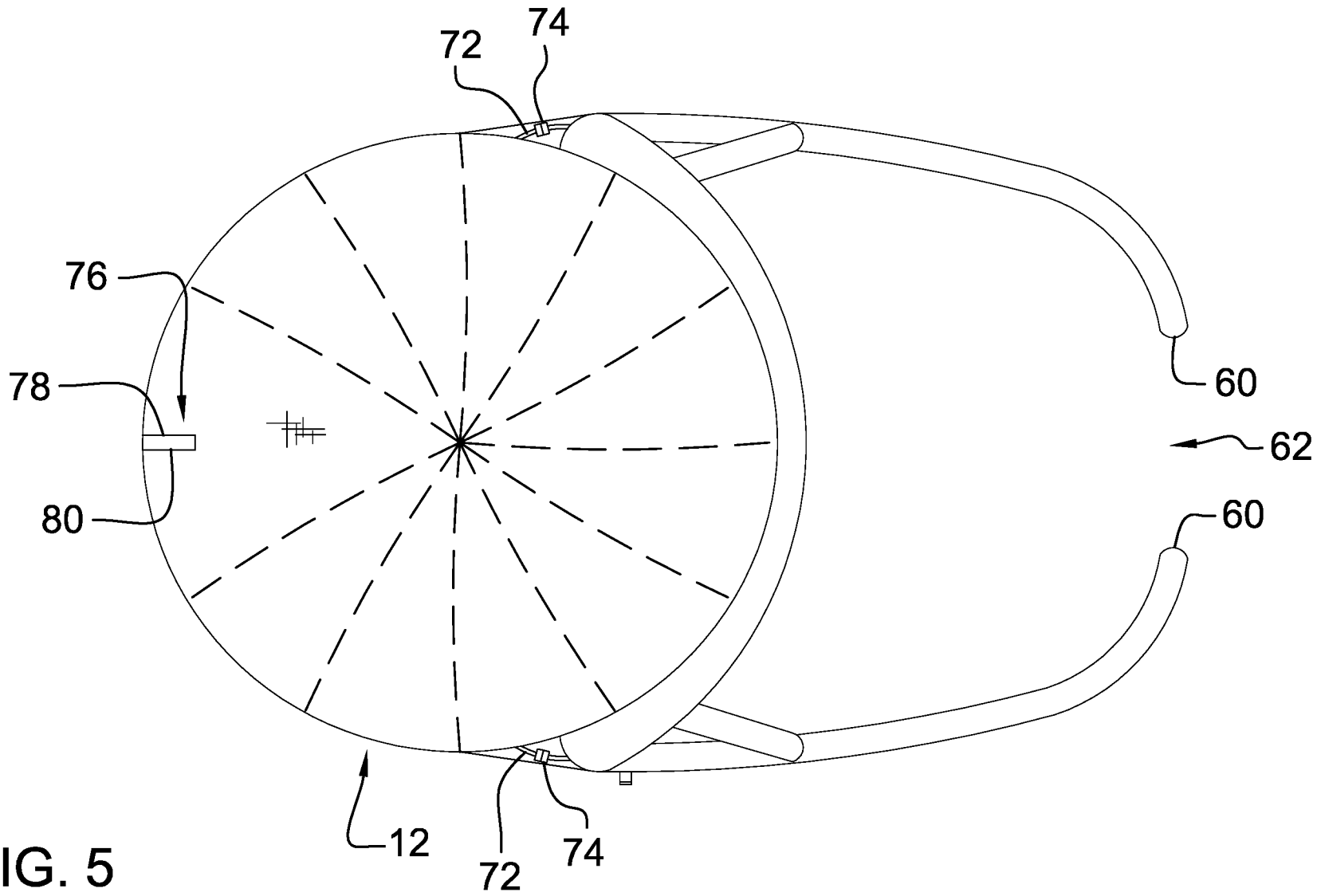
FIG. 5 is a top view of an embodiment of the disclosure.

With reference now to the drawings, and in particular to FIGS. 1 through 7 thereof, a new tent device embodying the principles and concepts of an embodiment of the disclosure and generally designated by the reference numeral 10 will be described.

As best illustrated in FIGS. 1 through 7, the deployable tent 12 assembly 10 generally comprises a tent 12 that is formed to define a dome 13 which has an opening 14 extending into an interior of the dome 13 when the tent 12 is erected. In this way the tent 12 is facilitated to have the ornamental appearance of an American football helmet. The tent 12 has a top surface 16, a bottom surface 18 and a perimeter edge 20 extending between the top surface 16 and the bottom surface 18. The perimeter edge 20 has a basal portion 22 curving around a center point of the dome 13 such that the basal portion 22 defines a U-shape. In this way the basal portion 22 can rest on a support surface 24 having the dome 13 curving upwardly from the support surface 24. The perimeter edge 20 has a pair of lobed portions 26 which each curve upwardly from a respective first lateral leg 28 and a second lateral leg 30 of the basal portion 22 to define a pair of lobes 32 on either side of the dome 13. Additionally, the perimeter edge 20 has an opening portion 34 curving rearwardly from each of the pair of lobes 32 and curving around a front side 36 of the dome 13 such that the opening portion 34 defines the opening 14 into the dome 13.

The tent 12 has a pair of holes 38 each extending through the top surface 16 and the bottom surface 18 and each of the holes 38 is centrally positioned on a respective one of the pair of lobes 32. The tent 12 has a cut 40 extending through the top surface 16 and the bottom surface 18 and the cut 40 extends from the basal portion 22 of the perimeter edge 20 toward an apex 42 of the dome 13. Furthermore, the cut 40 is centrally positioned between the first lateral leg 28 and the second lateral leg 30 of the basal portion 22. The tent 12 may be comprised of a rip resistant material, including but not being limited to, polyester or nylon. Indicia 44 may be applied to the top surface 16 of the tent 12 and the indicia 44 may comprise a logo, an image or graphics that represent an American football team, for example.

A plurality of tent poles 46 is provided and each of the plurality of tent poles 46 is integrated into the tent 12. The plurality of tent poles 46 biases the tent 12 to define the dome 13 and the plurality of tent 12 pole is disposed on the bottom surface 18 of the tent 12. The plurality of tent poles 46 radiate outwardly from the apex 42 of the dome 13 toward the perimeter edge 20. Each of the plurality of tent poles 46 may be comprised of a resiliently flexible material, including but not being limited to, fiberglass or plastic.

A balloon 48 is provided which comprises a plurality of intersecting members 50 being strategically arranged such that the balloon 48 has the ornamental appearance of a face mask of an American football helmet. The balloon 48 is inflatable thereby lending structural integrity to the balloon 48. The plurality of intersecting members 50 includes a primary member 52 curving between a pair of outward members 54 having the outward members 54 being spaced apart from each other and being oriented parallel to each other. The plurality of intersecting members 50 includes a set of first horizontal members 56 each curving forwardly from a respective one of the outward members 54. The plurality of intersecting members 50 includes a set of second horizontal members 58 each curving forwardly from a respective one of the outward members 54.

Each of the first horizontal members 56 and each of the second horizontal members 58 has a terminal end 60. The first horizontal members 56 curve toward the second horizontal members 58 having the terminal end 60 of each of the first horizontal members 56 being spaced from the terminal end 60 of each of the second horizontal members 58. In this way an entry space 62 is defined between the terminal end 60 of each of the first horizontal members 56 and the terminal end 60 of each of the second horizontal members 58 to facilitate an occupant to pass through the entry space 62. Each of the plurality of intersecting members 50 is substantially hollow and each of the plurality of intersecting members 50 is in fluid communication with each other.

A fill port 64 is fluidly integrated into the balloon 48 and the fill port 64 is in fluid communication with an interior of the balloon 48. The fill port 64 can be fluidly coupled to a source of compressed air 66 for inflating the balloon 48. The source of compressed air 66 may comprise an electric air pump, a manual air pump or any other source of readily available compressed air. The fill port 64 extends through an outer wall 68 of a respective one of the plurality of intersecting members 50 and the fill port 64 has a closure 70 for closing the fill port 64 to inhibit air within the balloon 48 from escaping through the fill port 64.

A pair of clasps 72 is each disposed on the top surface 16 of the tent 12 and each of the clasps 72 is positioned on opposite sides of the opening 14 into the dome 13 defined by the opening portion 34 of the perimeter edge 20 of the tent 12. A pair of buckles 74 is each disposed on a respective one of the pair of outward members 54 associated with the balloon 48. Each of the pair of buckles 74 extends rearwardly from the respective outward member 54. Furthermore, each of the buckles 74 releasably engages a respective one of the clasps 72 for attaching the balloon 48 to the tent 12 such that the balloon 48 wraps around the opening 14 into the dome 13. Each of the clasps 72 and buckles 74 may comprise a female coupler and a male coupler or any other type of multiple use, releasably means of attachment.

A closure 76 is integrated into the tent 12 and the closure 76 includes a first portion 78 and a second portion 80 each extending a long a full length of the cut 40 in the tent 12. The first portion 78 is releasably matable to the second portion 80 for opening 14 and closing the cut 40. In this way the cut 40 facilitates the occupants to pass through the cut 40 when the cut 40 is opened. The closure 76 may comprise a zipper or other type of mechanical closure 76. A plurality of ties 82 is each attached to the bottom surface 18 of the tent 12 and each of the ties 82 can be tied around flaps 84 formed when the cut 40 is opened for holding the cut 40 open.

Figure 6:
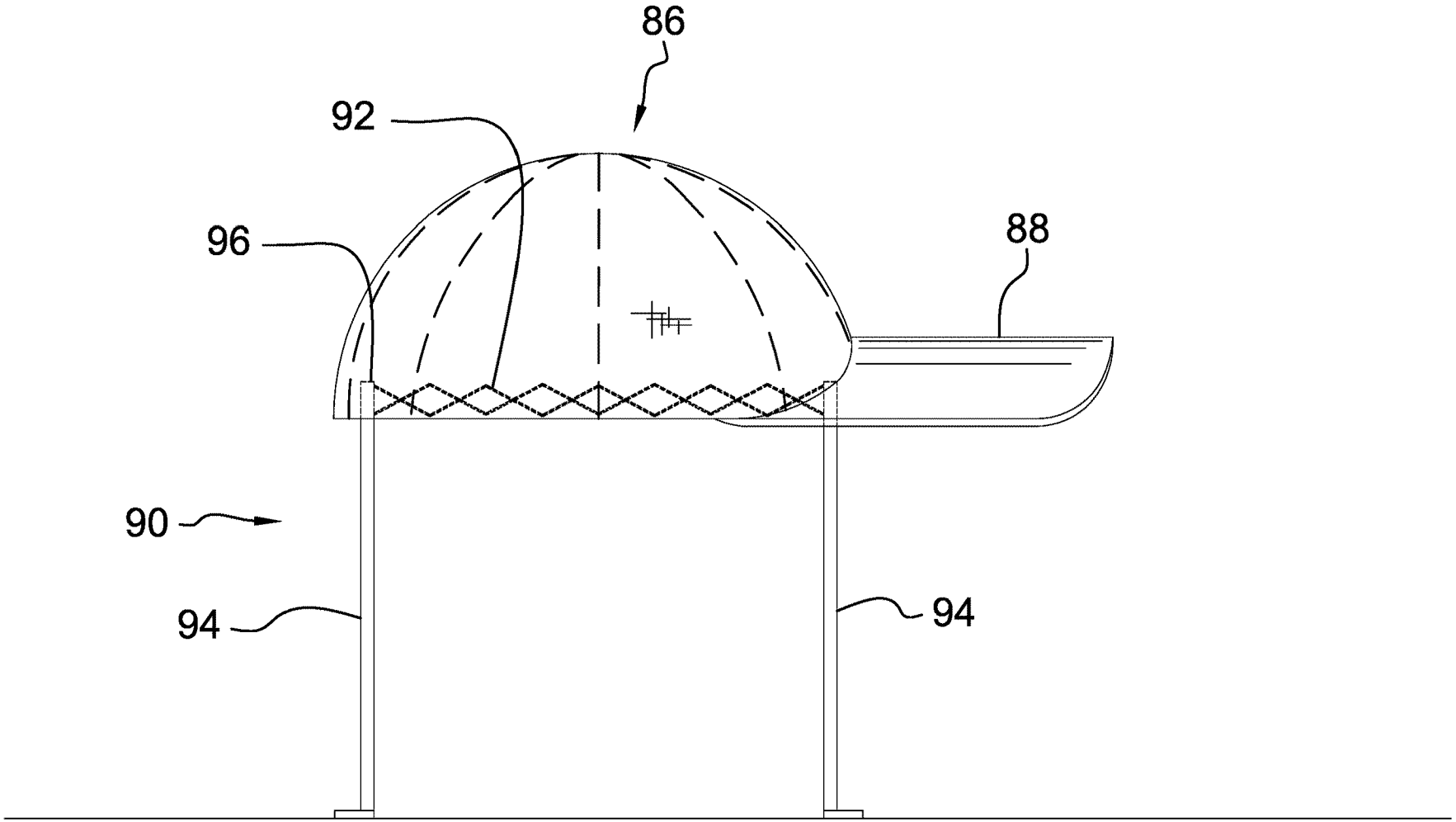
FIG. 6 is a right side view of an alternative embodiment of the disclosure.
Figure 7:
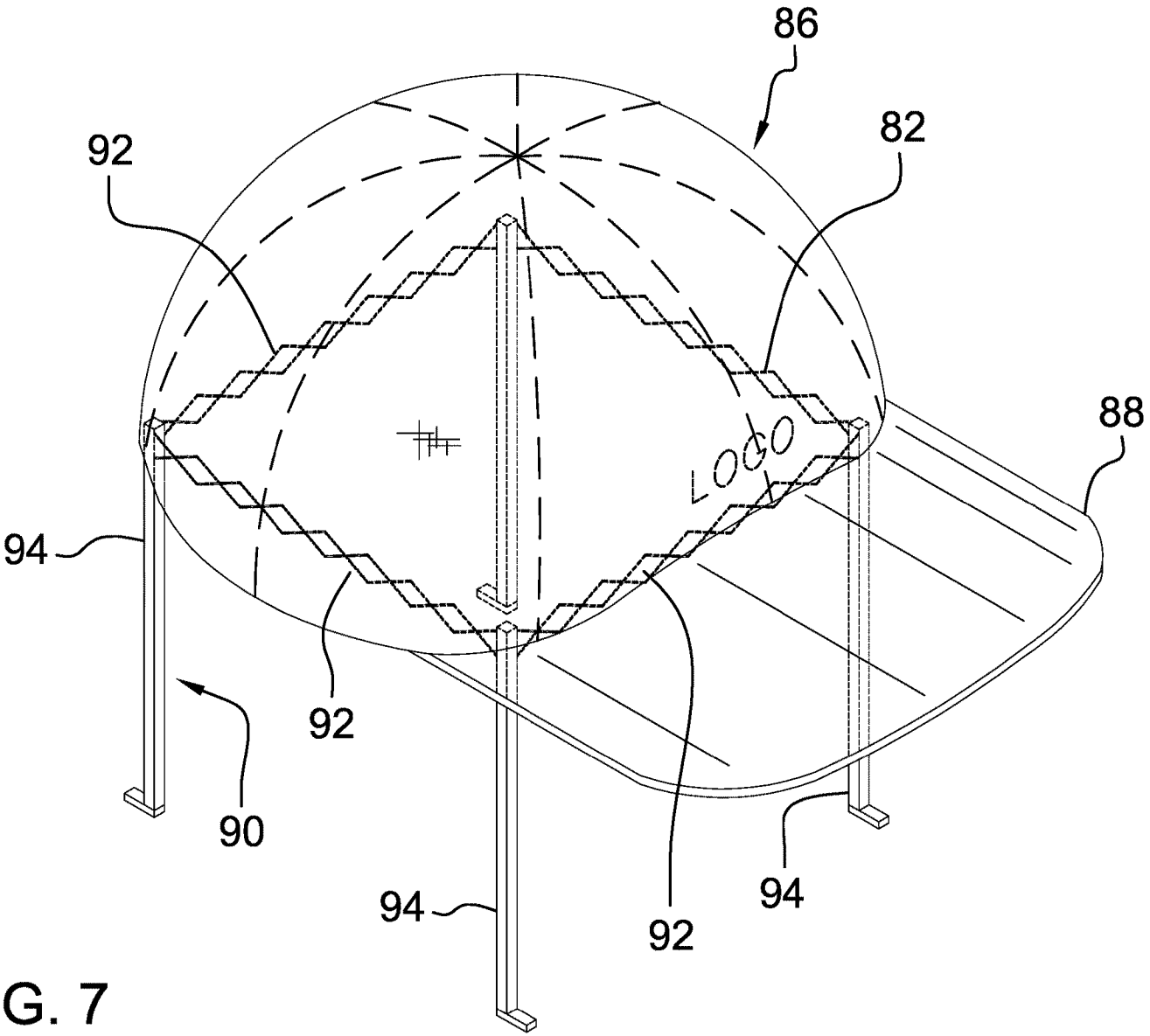
FIG. 7 is a perspective in-use view of an alternative embodiment of the disclosure.

In an alternative embodiment 86 most clearly shown in FIGS. 6 and 7, the perimeter edge 20 is continuously arcuate about the apex 42 of the dome 13 such that the perimeter edge 20 defines a circle. Additionally, the tent 12 includes a brim portion 88 extending laterally away from the top surface 16 of the tent 12 having the brim portion 88 being aligned with the perimeter edge 20. In this way the tent 12 has the ornamental appearance of a baseball cap. A cabana frame 90 is included in the alternative embodiment 86 which includes a plurality of scissor arms 92 extending between a respective pair of a plurality of legs 94. Each of the plurality of legs 94 defines a respective one of four corners of a rectangle and the plurality of scissor arms 92 are aligned with a top end 96 of the respective legs 94. The tent 12 is positionable on the cabana frame 90 to elevate the tent 12 over a support surface 24.

In use, the tent 12 is positioned such that the basal portion 22 of the perimeter edge 20 rests on the ground thereby facilitating the plurality of tent poles 46 to bias the tent 12 to define the dome 13. Each of the buckles 74 is attached to the respective clasp 72 and the fill port 64 of the balloon 48 is fluidly coupled to the source of compressed air 66 to inflate the balloon 48. In this way the tent 12 and the balloon 48 defines the American football helmet to enhance the occupant's enjoyment during tailgate parties and other sporting events that involve being outdoors. The closure 76 is opened and the ties 82 are tied around the flaps 84 to hold the cut 40 open. In this way the occupants can enter or exit the tent 12 either through the opening 14 defined in the dome 13 or through the cut 40.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A deployable tent assembly being structured to resemble a football helmet to facilitate a sheltered area for users to gather during a sporting event, said assembly comprising:

a tent being formed to define a dome having an opening extending into an interior of said dome when said tent is erected wherein said tent is configured to have the ornamental appearance of an American football helmet;

a plurality of tent poles, each of said plurality of tent poles being integrated into said tent, said plurality of tent poles biasing said tent to define said dome;

a balloon having a plurality of intersecting members wherein said balloon is configured to have the ornamental appearance of a face mask of an American football helmet, said balloon being inflatable thereby lending structural integrity to said balloon, said balloon being positionable to surround said opening defined in said dome; and a fill port being fluidly integrated into said balloon, said fill port being in fluid communication with an interior of said balloon wherein said fill port is configured to be fluidly coupled to a source of compressed air for inflating said balloon.

2. The assembly according to claim 1, wherein:

said tent has a top surface, a bottom surface and a perimeter edge extending between said top surface and said bottom surface, said perimeter edge having a basal portion curving around a center point of said dome such that said basal portion defines a U-shape wherein said basal portion is configured to rest on a support surface having said dome curving upwardly from the support surface;

said perimeter edge has a pair of lobed portions which each curve upwardly from a respective first lateral leg and a second lateral leg of said basal portion to define a pair of lobes on either side of said dome;

said perimeter edge has an opening portion curving rearwardly from each of said pair of lobes and curving around a front side of said dome such that said opening portion defies said opening into said dome; and said tent having a pair of holes each extending through said top surface and said bottom surface, each of said holes being centrally positioned on a respective one of said pair of lobes.

3. The assembly according to claim 2, further comprising a pair of clasps, each of said clasps being disposed on said top surface of said tent, each of said clasps being positioned on opposite sides of said opening into said dome defined by said opening portion of said perimeter edge of said tent.

4. The assembly according to claim 3, wherein:

said plurality of intersecting members comprising said balloon includes a pair of outward members; and said assembly includes a pair of buckles, each of said buckles being disposed on a respective one of said pair of outward members associated with said balloon, each of said pair of buckles extending rearwardly from said respective outward member, each of said buckles releasably engaging a respective one of said clasps for attaching said balloon to said tent such that said balloon wraps around said opening into said dome.

5. The assembly according to claim 2, wherein said tent has a cut extending through said top surface and said bottom surface, said cut extending from said basal portion of said perimeter edge toward an apex of said dome, said cut being centrally positioned between said first lateral leg and said second lateral leg of said basal portion.

6. The assembly according to claim 5, further comprising a closure being integrated into said tent, said closure including a first portion and a second portion each extending a long a full length of said cut in said tent, said first portion being releasably matable to said second portion for opening and closing said cut wherein said cut is configured to facilitate the occupants to pass through said cut when said cut is opened.

7. The assembly according to claim 1, wherein said plurality of tent pole is disposed on a bottom surface of said tent, said plurality of tent poles radiating outwardly from said apex of said dome toward a perimeter edge of said tent.

8. The assembly according to claim 1, wherein said plurality of intersecting members includes:

a primary member curving between a pair of outward members having said outward members being spaced apart from each other and being oriented parallel to each other;

a set of first horizontal members each curving forwardly from a respective one of said outward members;

a set of second horizontal members each curving forwardly from a respective one of said outward members, each of said first horizontal members and each of said second horizontal members having a terminal end;

said first horizontal members curves toward said second horizontal members having said terminal end of each of said first horizontal members being spaced from said terminal end of each of said second horizontal members to define an entry space between said terminal end of each of said first horizontal members and said terminal end of each of said second horizontal members wherein said entry space is configured to facilitate an occupant to pass through said entry space;

each of said plurality of intersecting members is substantially hollow; and each of said plurality of intersecting members is in fluid communication with each other.

9. A deployable tent assembly being structured to resemble a football helmet to facilitate a sheltered area for users to gather during a sporting event, said assembly comprising:

a tent being formed to define a dome having an opening extending into an interior of said dome when said tent is erected wherein said tent is configured to have the ornamental appearance of an American football helmet, said tent having a top surface, a bottom surface and a perimeter edge extending between said top surface and said bottom surface, said perimeter edge having a basal portion curving around a center point of said dome such that said basal portion defines a U-shape wherein said basal portion is configured to rest on a support surface having said dome curving upwardly from the support surface, said perimeter edge having a pair of lobed portions which each curve upwardly from a respective first lateral leg and a second lateral leg of said basal portion to define a pair of lobes on either side of said dome, said perimeter edge having an opening portion curving rearwardly from each of said pair of lobes and curving around a front side of said dome such that said opening portion defies said opening into said dome, said tent having a pair of holes each extending through said top surface and said bottom surface, each of said holes being centrally positioned on a respective one of said pair of lobes, said tent having a cut extending through said top surface and said bottom surface, said cut extending from said basal portion of said perimeter edge toward an apex of said dome, said cut being centrally positioned between said first lateral leg and said second lateral leg of said basal portion;

a plurality of tent poles, each of said plurality of tent poles being integrated into said tent, said plurality of tent poles biasing said tent to define said dome, said plurality of tent pole being disposed on said bottom surface of said tent, said plurality of tent poles radiating outwardly from said apex of said dome toward said perimeter edge;

a balloon having a plurality of intersecting members wherein said balloon is configured to have the ornamental appearance of a face mask of an American football helmet, said balloon being inflatable thereby lending structural integrity to said balloon, said plurality of intersecting members including a primary member curving between a pair of outward members having said outward members being spaced apart from each other and being oriented parallel to each other, said plurality of intersecting members including a set of first horizontal members each curving forwardly from a respective one of said outward members, said plurality of intersecting members including a set of second horizontal members each curving forwardly from a respective one of said outward members, each of said first horizontal members and each of said second horizontal members having a terminal end, said first horizontal members curving toward said second horizontal members having said terminal end of each of said first horizontal members being spaced from said terminal end of each of said second horizontal members to define an entry space between said terminal end of each of said first horizontal members and said terminal end of each of said second horizontal members wherein said entry space is configured to facilitate a occupant to pass through said entry space, each of said plurality of intersecting members being substantially hollow, each of said plurality of intersecting members being in fluid communication with each other;

a fill port being fluidly integrated into said balloon, said fill port being in fluid communication with an interior of said balloon wherein said fill port is configured to be fluidly coupled to a source of compressed air for inflating said balloon, said fill port extending through an outer wall of a respective one of said plurality of intersecting members, said fill port having a closure for closing said fill port wherein said closure is configured to inhibit air within said balloon from escaping through said fill port;

a pair of clasps, each of said clasps being disposed on said top surface of said tent, each of said clasps being positioned on opposite sides of said opening into said dome defined by said opening portion of said perimeter edge of said tent;

a pair of buckles, each of said buckles being disposed on a respective one of said pair of outward members associated with said balloon, each of said pair of buckles extending rearwardly from said respective outward member, each of said buckles releasably engaging a respective one of said clasps for attaching said balloon to said tent such that said balloon wraps around said opening into said dome; and a closure being integrated into said tent, said closure including a first portion and a second portion each extending a long a full length of said cut in said tent, said first portion being releasably matable to said second portion for opening and closing said cut wherein said cut is configured to facilitate the occupants to pass through said cut when said cut is opened.

* * * * *